US009926679B1

(12) United States Patent
Vila

(10) Patent No.: US 9,926,679 B1
(45) Date of Patent: Mar. 27, 2018

(54) BARRICADE SYSTEM WITH INTERLOCKING BARRICADE MEMBERS

(71) Applicant: Pedrail Systems, LLC, Miami, FL (US)

(72) Inventor: Miguel Vila, Miami, FL (US)

( * ) Notice: Subject to any disclaimer, the term of this patent is extended or adjusted under 35 U.S.C. 154(b) by 0 days.

(21) Appl. No.: 15/248,861

(22) Filed: Aug. 26, 2016

(51) Int. Cl.

| | |
|---|---|
| ***E01F 13/02*** | (2006.01) |
| ***E04H 17/16*** | (2006.01) |
| ***E04H 17/20*** | (2006.01) |
| ***E04H 17/18*** | (2006.01) |
| ***E01F 9/619*** | (2016.01) |

(52) U.S. Cl.
CPC ..... *E01F 13/022* (2013.01); *E01F 9/619* (2016.02); *E01F 13/024* (2013.01); *E04H 17/166* (2013.01); *E04H 17/18* (2013.01); *E04H 17/20* (2013.01)

(58) Field of Classification Search
CPC ..... E01F 9/619; E01F 13/022; E01F 13/024; E01F 13/026; E01F 13/04; E04H 17/166; E04H 17/18; E04H 17/20; E04H 17/22; E04H 17/1812
USPC ..... 256/13.1, 30, 31, 65.14; 248/519, 523, 248/534, 535, 539, 188, 431, 440.1, 248/188.1, 188.2, 188.3, 346.01, 346.11, 248/346.5
See application file for complete search history.

(56) References Cited

U.S. PATENT DOCUMENTS 3,825,229 A * 7/1974 Bartlett ..... E04F 11/1804 248/251
4,909,483 A * 3/1990 van Herpen ..... E04G 21/3233 182/113
5,402,988 A * 4/1995 Eisele ..... E01F 13/022 160/351
5,609,327 A * 3/1997 Amidon ..... E04H 17/18 256/19
5,941,002 A * 8/1999 Rusin ..... G09F 15/0006 40/605
6,190,084 B1 * 2/2001 Ibanez ..... E01F 13/02 160/351
6,616,368 B2 * 9/2003 Birchler ..... E01F 13/02 256/13.1
6,682,055 B1 * 1/2004 Tomlinson ..... E01F 13/022 248/129
6,712,330 B1 * 3/2004 Damiano ..... E04H 12/2261 248/519

(Continued)

FOREIGN PATENT DOCUMENTS

GB 2539573 A * 12/2016 ..... E04H 12/2261

*Primary Examiner* — Josh Skroupa
*Assistant Examiner* — Cory B Siegert
(74) *Attorney, Agent, or Firm* — Sanchelima & Associates, P.A.; Christian Sanchelima, Esq.; Jesus Sanchelima, Esq.

(57) ABSTRACT

A barricade with a plurality of interlocking barricade members hingedly coupled to each other. Each of the interlocking barricade members include two vertical posts between which horizontal barricade members are mounted. The interlocking barricade members includes a base assembly onto which the vertical post is supported, such that the base assembly is rotatable and removable with respect to the vertical post. The base assembly is entirely behind and extends away from the barricade's rear face, thereby keeping the barricade and all its components out of a given walkway to avoid becoming a hazard to pedestrian traffic.

17 Claims, 5 Drawing Sheets

(56) References Cited

U.S. PATENT DOCUMENTS

| | | | | |
|---|---|---|---|---|
| 7,540,682 | B1 * | 6/2009 | Christensen | E01F 13/022 116/63 P |
| 2003/0178614 | A1 * | 9/2003 | Venegas, Jr. | E01F 13/024 256/65.1 |
| 2004/0188667 | A1 * | 9/2004 | Ray | A01K 3/00 256/67 |
| 2010/0065697 | A1 * | 3/2010 | Howlett | E04H 12/2238 248/166 |
| 2012/0261632 | A1 * | 10/2012 | Bertucat | E01F 13/022 256/26 |
| 2013/0062585 | A1 * | 3/2013 | Deering | E01F 13/022 256/65.01 |

* cited by examiner

BARRICADE SYSTEM WITH INTERLOCKING BARRICADE MEMBERS

BACKGROUND OF THE INVENTION

1. Field of the Invention

The present disclosure generally relates to a barricade system with interlocking barricade members; and more particularly to a barricade system having interlocking barricade members with a rotatable and removable base assembly.

2. Description of the Related Art

Many properties include walkways or sidewalks, which may require a considerable length of barricades obstructing their path. Furthermore, some circumstances require setting-up temporary barriers to enclose or define areas reserved for a particular purpose, such as, crowd control or to define access routes. Another example is for construction, maintenance and repair work, where barricades must be moved frequently from one position to another at a construction site. Concrete barriers, as previously used, are heavy, and require special equipment such as fork lifts or cranes for moving and installation, and are thus not suitable for these applications. Presently, metal fencing, or plastic barricades are often employed. One common technique for mounting metal fencing is to fix anchors to the ground and mount vertical posts onto such anchors by nuts and bolts, or the like. Thereafter, barricade horizontal panels and/or rails may be mounted between the two posts. In some cases, the base members are in the form of sockets fixed to the ground, and the vertical posts are inserted into such sockets for relatively quick assembly.

However, the known barricade systems employ base members which are fixedly connected to the barricade systems and are further fixedly mounted to the ground. Such base members may often interfere with the walkways, when the barricade system is erected along the sides of such walkways. Therefore, it is desired that the base members may be able to swivel with respect to the vertical post in order to be rotated to a side which is away from the regular path, say the pedestrian path, of the sidewalk. The same swiveling functionality of the base is desired with barricades made of other materials such as plastic or aluminum.

Applicant believes that a related reference corresponds to U.S. Pat. No. 6,190,084 (hereinafter referred to as '084 patent), issued to Pere Mares Ibañez; which discloses a modular separating barrier element. The modular separating barrier element of the '084 patent includes a frame of generally rectangular structure which is molded from synthetic material and which borders an inner panel having plain regions and regions having perforations and other regions having reinforcing ribs. Each of the shorter sides may include a pair of projections, those on one of the sides having respective vertical through-holes and those on the other side having respective pairs of coaxial rods which extend vertically and which can be fitted in the holes of the projections of an adjacent barrier element.

The rectangular body of the barrier element of the '084 patent has lower bracket-like portions for increasing strength in the vicinity of the feet and has swivel coupling of the support feet, thus enabling the feet to adopt to the most suitable position for supporting the barrier element. However, the said lower bracket-like portions of the '084 patent are shaped in a manner which may not be easily supported on and fixed to the ground, for example after being adjusted to the desired position; and thus could lead to tumbling of the whole barricade system, such as, in case of large force from a strong wind gust or crowd being controlled by such barricade system.

Other documents describing the closest subject matter provide for a number of more or less complicated features that fail to solve the problem in an efficient and economical way. None of these patents suggest the novel features of the present invention.

SUMMARY OF THE INVENTION

An objective of the present invention is to provide a barricade system which has interlocking barricade member for easy and quick assembly on site with minimum skill.

Another objective of the present invention is to provide a barricade system in which the interlocking barricade member has a removable and rotatable base assembly, such that the base assembly may be swiveled with respect to the vertical posts, thereby keeping any part of the barricade system out of the walk path.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Figure 1:
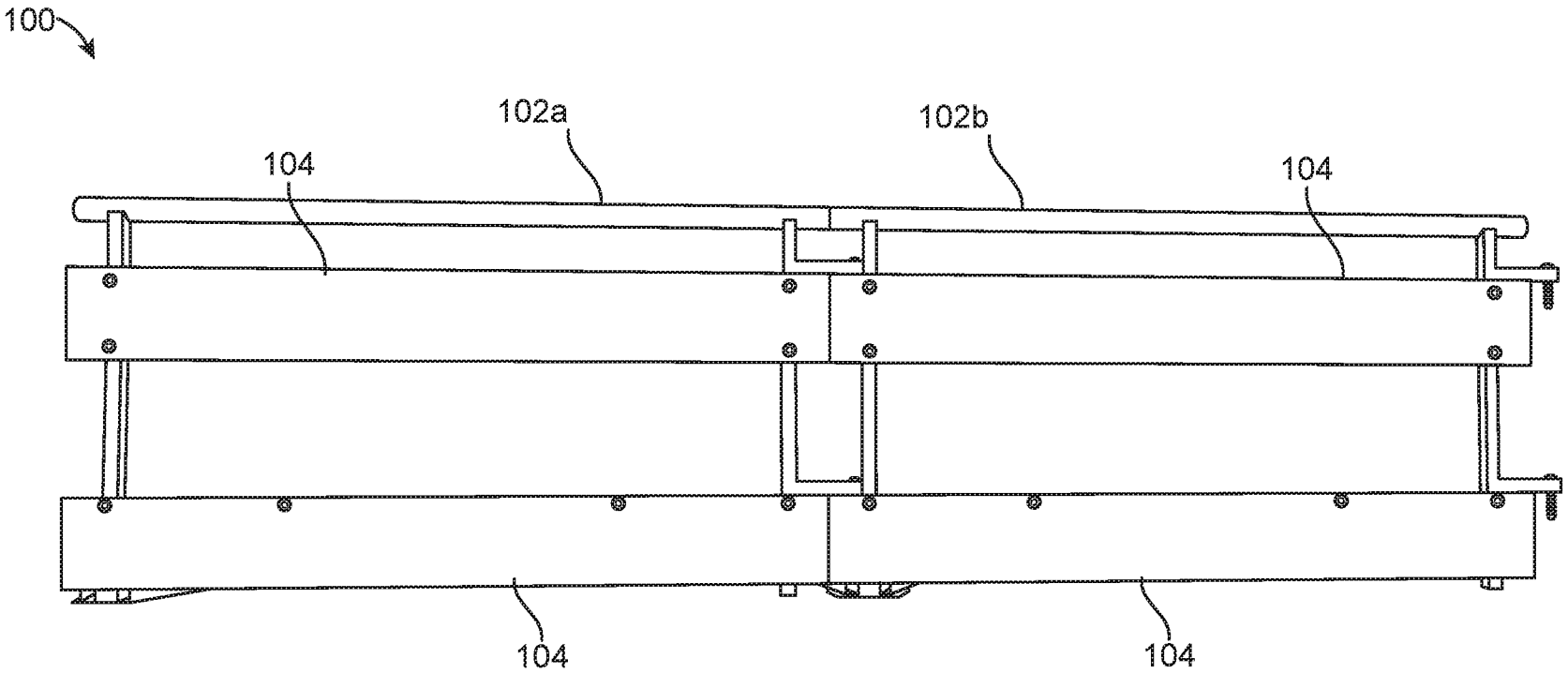
FIG. 1 illustrates a front elevational view of a barricade system, in accordance with an embodiment of the present disclosure.

FIG. 1 illustrates a barricade system 100, in accordance with an embodiment of the present invention. The barricade system 100 of the present invention may be adapted to be installed along sidewalks; however other possible applications of the barricade system 100 may be contemplated without any limitations. The barricade system 100 may include a plurality of interlocking barricade members 102*a*; 102*b* which are connected with each other in an end-to-end relationship. The number of interlocking barricade members

102*a*; 102*b*, in the barricade system 100, may depend on the required length of the barricade system 100. In the illustrated example of FIG. 1, the barricade system 100 includes a first interlocking barricade member 102*a*, and a second interlocking barricade member 102*b* adjacently disposed to the first interlocking barricade member 102*a*. In some examples of the present invention, the interlocking barricade members 102*a*; 102*b* may be disposed in a manner such that the first interlocking barricade member 102*a* may be rotatable to an extent with respect to the adjacent second interlocking barricade member 102*b*, in the barricade system 100.

Further, as illustrated in FIG. 1, the barricade system 100 may include one or more horizontal barricade members 104 supported and mounted on each of the interlocking barricade members 102. The horizontal barricade member 104 may be formed of any suitable material, such as plastic steel or easily moldable synthetic resin, having good weather-resistance characteristics. In some examples, the horizontal barricade members 104 may be formed by co-extrusion of recycled plastics material for the interior, and a finishing material, having desired material color and quality characteristics, for the exterior. Further, in some examples, the horizontal barricade members 104 may use bright color paints for the exterior coating to improve the visibility thereof.

Figure 2:
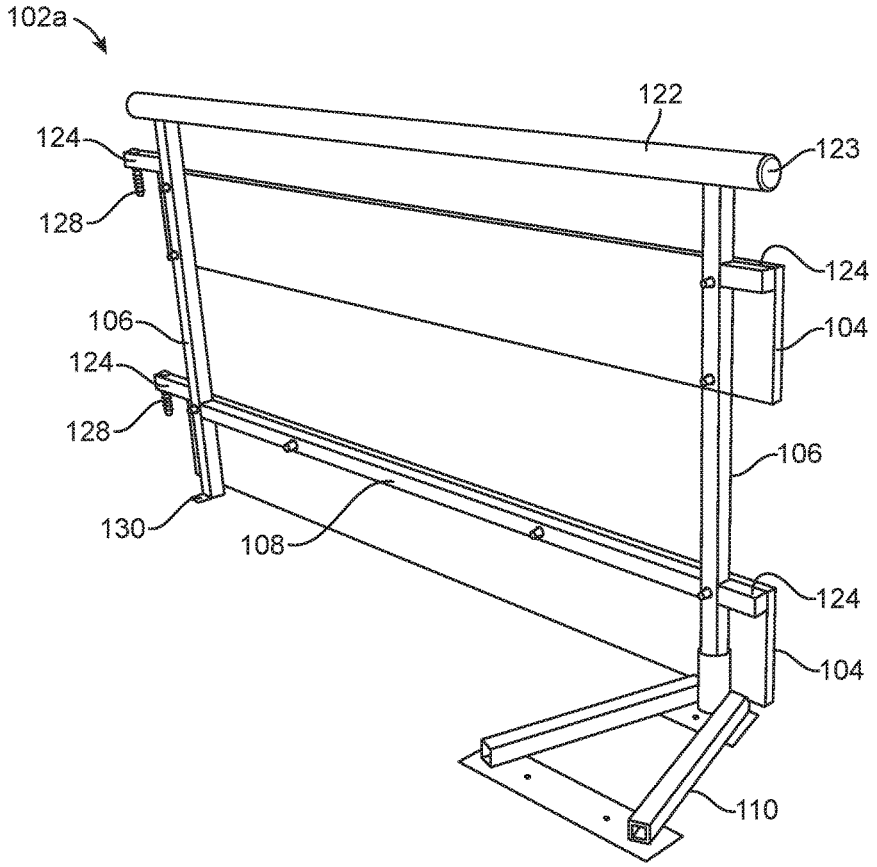
FIG. 2 illustrates a side isometric view of an interlocking barricade member of the barricade system.

Referring to FIG. 2, it may be seen that the interlocking barricade members 102*a* includes two vertical posts 106 located substantially at two longitudinal opposing ends thereof and spaced apart by horizontal barricade members 104. In a preferred example, the vertical posts 106 are hollow extruded rectangular members; however any other suitable shape for the vertical posts 106 may be employed, including, but not limited to, a hollow cylindrical shape, hollow triangular shape or the like. The hollow shapes of the vertical posts 106 help to limit the overall weight of the interlocking barricade member 102*a*. In one example, as illustrated, the horizontal barricade members 104 are mounted, in the interlocking barricade member 102, between the two vertical posts 106. The horizontal barricade member 104 may be mounted to the vertical post 106 by using any suitable fastening arrangement, such as, nuts and bolts, or the like. In some examples, the longitudinal length of the horizontal barricade member 104 may be slightly greater than the distance between the two vertical posts 106.

In an embodiment of the present invention, the interlocking barricade member 102*a* includes a horizontal rib 108 extending between and fixed to the two vertical posts 106. In one example, the horizontal rib 108 may be of hollow extruded rectangular shape, similar to the vertical posts 106. In some examples, the horizontal rib 108 may be fixed to the two vertical posts 106 by welding means. In other examples, the horizontal rib 108 may be formed along with the two vertical posts 106 during molding of the interlocking barricade member 102*a*. The horizontal rib 108 provides reinforcement to the interlocking barricade member 102*a* by rigidly connecting the two vertical posts 106. In some examples, the interlocking barricade member 102*a* may include more than one horizontal rib 108 connecting the vertical posts 106 therein, in order to provide extra strength to the structure; particularly for vertically high interlocking barricade members.

Figure 3:
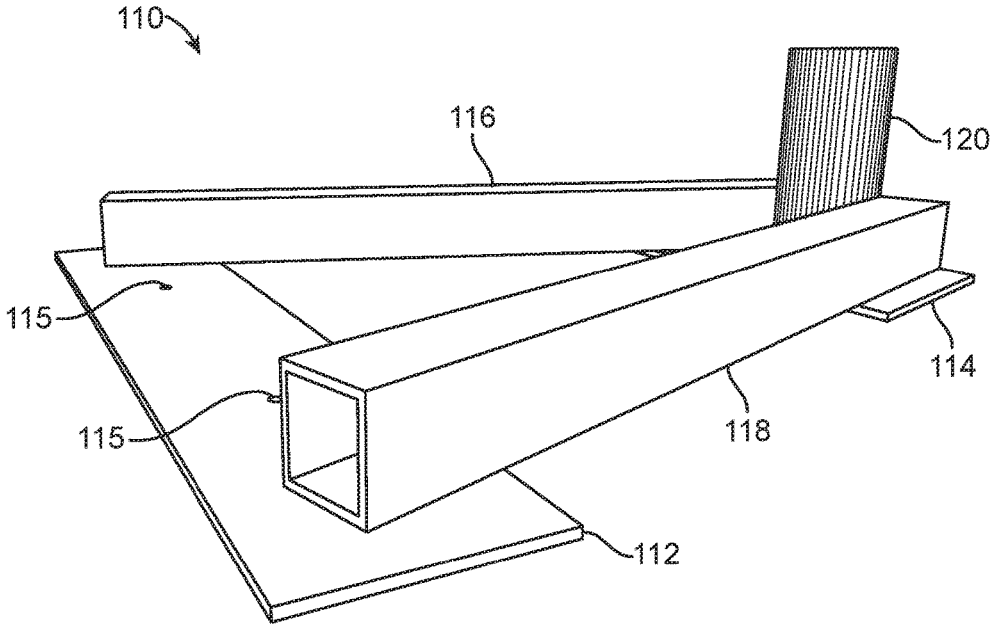
FIG. 3 illustrates an isometric view of base assembly 110 of the interlocking barricade member.

Further, the interlocking barricade member 102*a* includes a base assembly 110 for supporting the vertical post 106 thereof, above the ground. FIG. 3 illustrates a perspective view of the base assembly 110, in accordance with an embodiment of the present invention. As illustrated, the base assembly 110 includes two supporting plates, a first supporting plate 112 and a second supporting plate 114. In general, the two supporting plates 112, 114 are of usually same width and thickness. In some examples, the first supporting plate 112 may be larger in longitudinal length compared to the second supporting plate 114. The two supporting plates 112, 114 may be made of same material, of high tensile strength for supporting the weight of other components of the interlocking barricade member 102*a* along with the plurality of horizontal barricade members 104. In some examples, the supporting plates 112, 114 may further include drilling holes 115, which allow for some fastening member, such as screws, nails, etc. to pass through, in order to fix the supporting plates 112, 114 to the ground. Specifically, in one example, the first supporting plate 112 may include two drilling holes 115 and the second supporting plate 114 may include one drilling hole 115 therein.

Further, as illustrated in FIG. 3, the base assembly 110 may include two support members 116, 118 spaced apart from each other at a predetermined distance. The two strengthening members 116, 118 are of the same shape and design, and made of same material of high compressive and shear strength. In the illustrated example, the two support members 116, 118 are shown as hollow extruded rectangular member; however any other suitable shape of the support members 116, 118 may be employed. In some examples, the support members 116, 118 may be solid members for increasing its strength. In one embodiment, the base assembly 110 may further include a socket member 120 supported on the second supporting plate 114. As may be contemplated from FIG. 2, the socket member 120 of the base assembly 110 may be adapted to receive a lower portion of the vertical post 106, in the interlocking barricade member 102*a*. In some examples, the socket member 120 may be in the shape of hollow cylinder; and the lower portion of the vertical post 106 may have a complementary exterior cylindrical shape, such that the exterior cylindrical surface of the lower portion of the vertical post 106 mates with and engages into an interior cylindrical recess of the socket member 120. In alternative examples, however, the socket member 120 may have some other shape including rectangular shape to conform to the shape of the lower portion of the vertical post 106.

In one example, the two support members 116, 118 may be fixedly connected to the two supporting plates 112, 114 from their respective two ends. The support member 116 may be connected to the first supporting plate 112 at its first end and the second supporting plate 114 at its second end, and similarly the support member 118 may be connected to the first supporting plate 112 at its first end and the second supporting plate 114 at its second end, as shown in FIG. 3. It may be seen that the support members 116, 118 may be connected at the second supporting plate 114 such that their respective two ends are disposed along opposite sides of outer circumference of the socket member 120. Further, it may be seen that the two support members 116, 118 may be disposed with respect to each other in an angular manner, such that the distance between first ends of the two support members 116, 118 at the first supporting plate 112 is slightly greater than the distance between second ends of the two support members 116, 118 at the second supporting plate 114. This triangular shape of the base assembly 110 provides a truss-like arrangement for overall strength of the structure.

In one example, the support members 116, 118 and the socket member 120 may be connected to the supporting plates 112, 114 and with each other, using fixing means, such as but not limited to, welding. In a preferred embodiment, support members 116, 118 and the socket member 120 may be connected to the supporting plates 112, 114 using bolts. In yet other example, the entire base assembly 110 may be formed as a unitary structure, using molding techniques or the like. It may be understood that the base assembly 110 may be removable in relation to the vertical post 106, in the interlocking barricade member 102*a* further, it may be contemplated that the base assembly 110 may be rotatable with respect to the vertical post 106, particularly about the socket member 120, by making socket member 120 of greater diameter than the bottom of the vertical post 106.

Referring back to FIG. 2, the interlocking barricade member 102 may include a hand rail 122, generally, supported on the top portions of the two vertical posts 106. As more clearly illustrated in FIG. 4, the vertical post 106 may include a semi-circular or 'C'-shaped section at its top portion to support and conform to the external cylindrical shape of the hand rail 122. In a preferred example, the hand rail 122 may have a hollow cylindrical shape; however other shapes including hollow rectangular shape may be used without any limitations. In one example, the interlocking barricade member 102*a* may further include two caps 123 which are adapted to be located inside the two circular ends of the hand rail 122. For this purpose, the caps 123 may be made of some soft or resilient material and have a mushroom shape with a broad head portion and a narrow stein portion, with the narrow stein portion being received in the circular ends of the hand rail 122. In one example, the length of the hand rail 122 is substantially equal to the length of the horizontal barricade member 104; and these components, in turn, define the overall span of the interlocking barricade member 102*a*.

Figure 4:
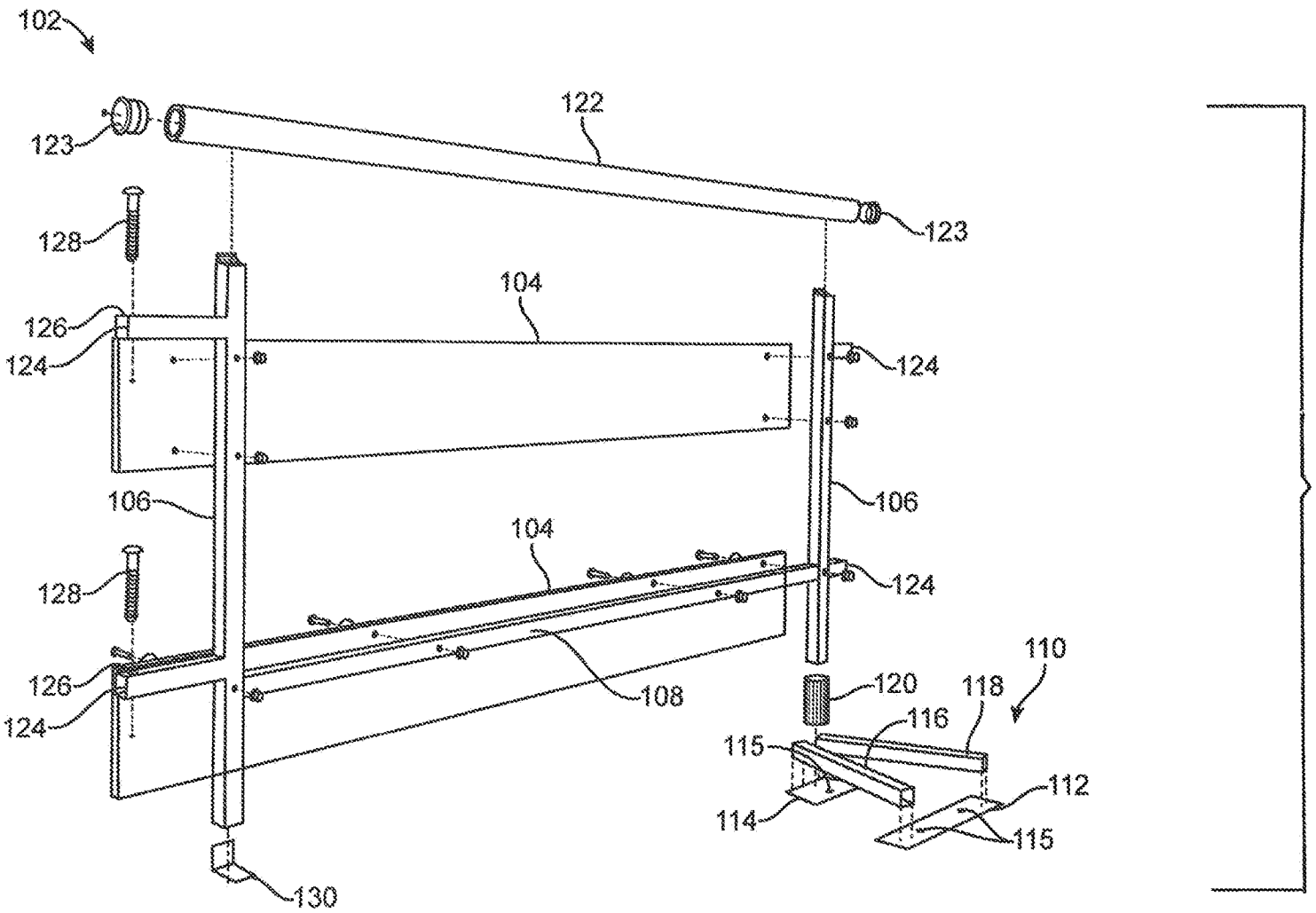
FIG. 4 illustrates an exploded isometric view of the interlocking barricade member.
Figure 5:
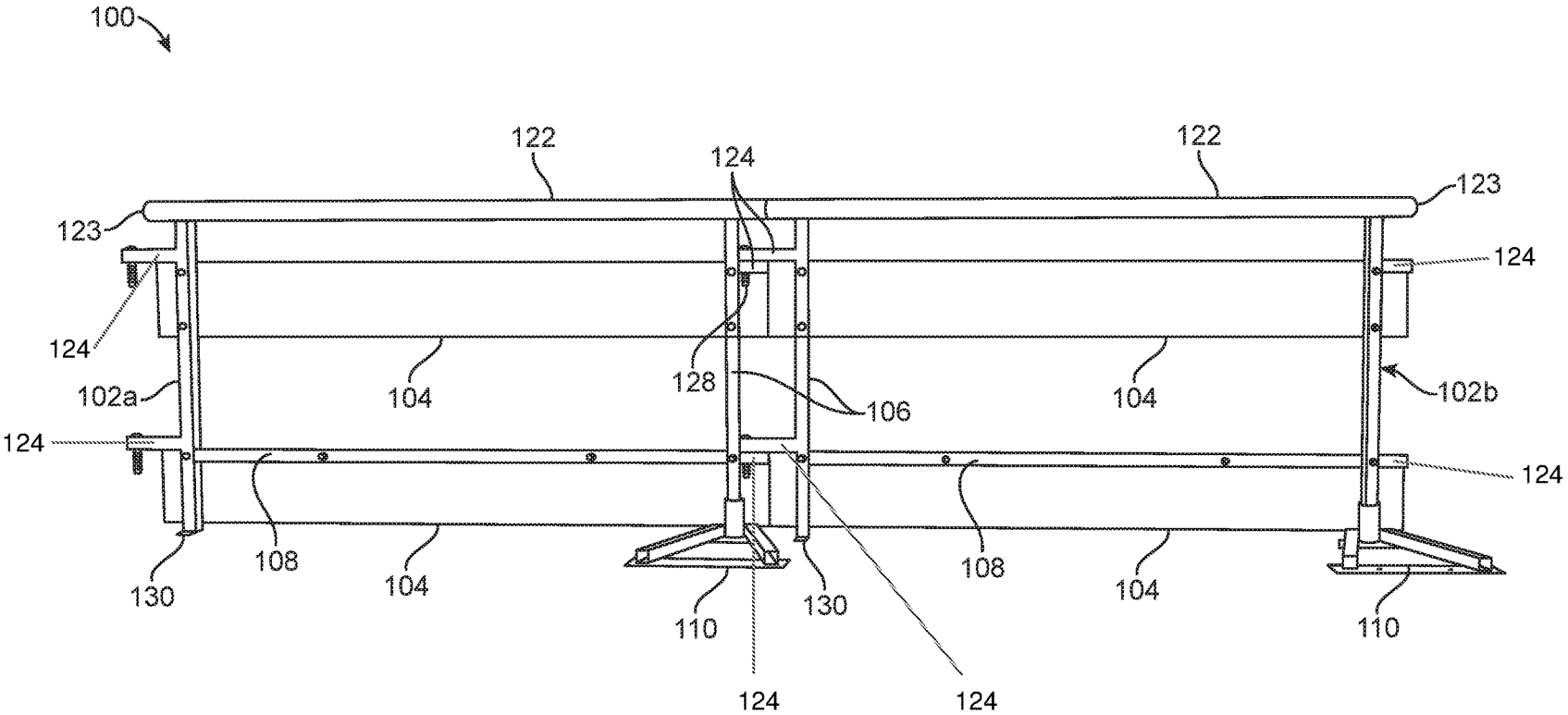
FIG. 5 illustrates a rear elevational view of the barricade system.

Further, in an embodiment, the interlocking barricade member 102*a* may include horizontal extension members 124, which are used to connect adjacent interlocking barricade members 102*b*, as well as others, in the barricade system 100. As illustrated in FIGS. 2, 4, and 5 the horizontal extension members 124 may be protruding from the vertical posts 106; such that the horizontal connecting members 124 from one vertical post 106 may be extending in a first horizontal direction and the horizontal connecting members 124 from other vertical post 106 may be extending in a direction opposite to the first horizontal direction. In some examples, the interlocking barricade member 102*a* may include two or more horizontal connecting members 124 protruding from each of the two vertical posts 106.

FIG. 5 illustrates the connection between the two adjacent interlocking barricade members 102*a*; 102*b* of the barricade system 100. It may be contemplated that the heights of the two horizontal extension members 124 of the adjacent interlocking barricade members 102*b* may be off-set, such that the said two horizontal extension members 124 form a butt joint therebetween. It may be seen that the horizontal connecting members 124 from one vertical post 106, with base assembly 110, are shorter compared to corresponding horizontal extension members 124 from other vertical post 106 of the adjacent interlocking barricade members 102*b* for formation of butt joint therebetween. In some embodiments, as illustrated in FIGS. 4 and 5, the interlocking barricade member 102*a* may also include a L-shaped bracket 130 disposed with and connected below the lower portion of one of the two vertical posts 106. In particular, the L-shaped bracket 130 may be disposed with the vertical post 106 which is not supported on the base assembly 110. The L-shaped bracket 130 may raise the height of the vertical post 106 in order to facilitate the formation of the said butt joint as the two interlocking barricade members 102*a*; 102*b* are positioned adjacent to each other.

Further, as may be understood from the combination of FIGS. 4 and 5, the horizontal extension members 124 may include an anchoring channel 126 which is in the form of an extrusion in the vertical direction near its distal end. As the two interlocking barricade members 102 are placed adjacent to each other such that the butt joint is formed between the horizontal extension members 124 thereof, the anchoring channels 126 of these horizontal extension members 124 of different interlocking barricade members 102*a*; 102*b* are aligned with each other; and a locking bolt 128 may be driven through the anchoring channels 126 in order to hingedly couple the two interlocking barricade members 102*a*; 102*b*, in the barricade system 100.

It may be understood that a number of interlocking barricade members 102*n* may be coupled in a similar manner to form the barricade system 100 of a required length. As mentioned above, the base assembly 110 may be fixed to the ground by driving the screws or the like through the drilling holes 115; otherwise the base assemblies 110 may just be supported on the ground under the weight of the vertical posts 106, and, in general, the overall weight of the interlocking barricade system 100. It may be understood that, in some cases, the base assembly 110 may be swiveled with respect to the vertical post 106, such that the base assembly 110 could be swiveled away to avoid interfering with the walkways. Furthermore, the hinged coupling between the interlocking barricade members 102*a*; 102*b* allow for the barricade system 100 to be erected on curved or zigzag pathways and/or both uphill and downhill slopes. It may be contemplated, in one example, the horizontal extension members 124 may extend outwardly from the vertical post 106 up to the end of the horizontal barricade member 104 and/or the hand rail 122, such that these component are flushed with each other as the two interlocking barricade members 102*a*; 102*b* are coupled, so that there are no substantial gaps along the longitudinal length of the barricade system 100.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A barricade comprising, a front and rear side, at least two vertical posts spaced apart with respect to each other, said at least two vertical posts each having a top and bottom distal end, a base assembly mounted to the bottom of at least one of said vertical posts, said base assembly located entirely behind the rear side of said barricade, said base assembly including a first and second member extending away from said rear side and positioned with respect to each other at no more than a 90 degree angle, thereby not impeding pedestrians walking adjacent to the front side of said barricade, and at least two plates located below and mounted to said first and second member, said at least two plates include a first and second plate; said first and second members mounted in a V-shaped configuration creating a proximal spacing between said first and second members and a distal spacing between said first and second members, said first plate mounted underneath said first and second members at said proximal spacing, said second plate mounted underneath said first and second members at said distal spacing.

2. The barricade of claim 1 wherein said barricade includes a handrail mounted longitudinally from the top distal end of one of said at least two vertical posts to the top distal end of one of said at least two vertical posts.

3. The barricade of claim 2 wherein said handrail includes at least one lateral distal end, said at least one lateral distal end of said handrail including a cap.

4. The barricade system of claim 1 wherein said barricade includes at least one horizontal barricade panel extending perpendicularly from one of said at least two vertical posts to one of said at least two vertical posts.

5. The barricade system of claim 4 wherein said at least one horizontal barricade panel includes a front and rear side, said front or rear side including reflective material.

6. The barricade of claim 1 wherein said first and second plate members include a plurality of openings adapted to receive fastening means to fasten said plate members to a surface, thereby securing said base assembly.

7. The barricade of claim 1 wherein said first plate includes one opening and second plate includes two openings.

8. The barricade of claim 1 wherein said base assembly includes a socket member that connects said base assembly to the bottom distal end of said at least one vertical post.

9. The barricade of claim 8 wherein said first and second members are rigidly mounted to said socket member.

10. The barricade of claim 9 wherein said first and second members extend in a V-shaped configuration away from said socket member.

11. The barricade of claim 10 wherein said socket member is mounted to said at least two plates.

12. The barricade of claim 1 wherein said base assembly is configured to be rotatable 360 degrees with respect to said at least one vertical post.

13. The barricade of claim 1 wherein one of said at least two vertical posts includes an L-shaped bracket mounted to said bottom distal end.

14. The barricade of claim 1 being interlocking including at least one horizontal extension member extending outwardly from each of said vertical post and each further including an anchoring channel adapted to receive fastening members, said at least one horizontal extension member cooperating with the at least one horizontal extension member of a complementing interlocking barricade member so that a fastening means can be inserted through the anchoring channel of the at least one horizontal extension member of the interlocking barricade and into the anchoring channel of the at least one horizontal extension member of the complementing interlocking barricade member, thereby interlocking both interlocking barricade members.

15. The barricade of claim 14 wherein said fastening members are bolts or screws or any combination thereof.

16. The barricade of claim 15 wherein said interlocking barricade can be rotated about said horizontal extension members to open or close the angle between said interlocking barricade and said complementing barricade.

17. The barricade of claim 1 wherein said angle is no more than 90 degrees.

* * * * *